United States Patent [19]

Ochiai et al.

[11] Patent Number: 4,537,520

[45] Date of Patent: Aug. 27, 1985

[54] DOT PRINTER HEAD WITH REDUCED MAGNETIC INTERFERENCE

[75] Inventors: Kuniaki Ochiai; Shigeo Komakine, both of Shizuoka, Japan

[73] Assignee: Tokyo Electric Co., Ltd., Tokyo, Japan

[21] Appl. No.: 552,066

[22] Filed: Nov. 15, 1983

[30] Foreign Application Priority Data

| | | | |
|---|---|---|---|
| Nov. 16, 1982 | [JP] | Japan | 57-201430 |
| Dec. 20, 1982 | [JP] | Japan | 57-223405 |
| Jan. 31, 1983 | [JP] | Japan | 58-14219 |

[51] Int. Cl.[3] ..... B41J 3/12

[52] U.S. Cl. ..... 400/124; 101/93.05; 335/281

[58] Field of Search ..... 400/124, 157.2, 121; 101/93.05, 93.04, 93.48; 335/281

[56] References Cited

U.S. PATENT DOCUMENTS

| | | | |
|---|---|---|---|
| 4,233,894 | 11/1980 | Barrus et al. | 400/124 X |

FOREIGN PATENT DOCUMENTS

| | | | |
|---|---|---|---|
| 2469288 | 5/1981 | France | 400/124 |
| 148178 | 11/1980 | Japan | 400/124 |
| 27357 | 3/1981 | Japan | 400/124 |
| 22073 | 2/1982 | Japan | 400/124 |

OTHER PUBLICATIONS

*IBM Tech. Disc. Bulletin,* by G. Engel et al, vol. 15, No. 3, Aug., 1972, p. 916, 101–93.48.

*Primary Examiner*—Paul T. Sewell

*Attorney, Agent, or Firm*—Oblon, Fisher, Spivak, McClelland & Maier

[57] ABSTRACT

The present invention provides a dot printer head which includes a plurality of cores each having a mounting portion which is contacted with a core holding face of a permanent magnet and a post-like projection for mounting an electromagnetic coil thereon. The height of the mounting portion is made relatively small while the area of the mounting portion is made larger than the area of the cross section of the post-like projection. Due to this arrangement, sufficient magnetic fluxes are provided to the cores and magnetic interference between adjacent cores is reduced.

7 Claims, 18 Drawing Figures

PRIOR INVENTION (a) PRIOR INVENTION (b) PRIOR INVENTION

PRIOR INVENTION

PRIOR INVENTION

PRIOR INVENTION

DOT PRINTER HEAD WITH REDUCED MAGNETIC INTERFERENCE

FIELD OF THE INVENTION

This invention relates to a dot printer head in which a plurality of needles are selectively actuated to form dots with impacting forces thereof to print a character or figure with a group of dots.

OBJECT OF THE INVENTION

The first object of the present invention is to provide a dot printer head which has reduced magnetic interference between cores to allow actuation of the cores in a predetermined fixed condition.

The second object of the invention is to provide a dot printer head in which arrangement of cores in a spaced relationship would not reduce magnetic fluxes flowing through the cores themselves.

The third object of the invention is to provide a dot printer head in which armatures are reduced in weight to allow printing at a high speed.

DESCRIPTION OF THE PRIOR ART

Figure 1:
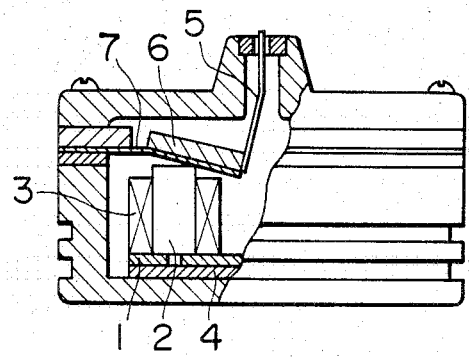
FIG. 1 is a side elevational view, partly in section, showing a first example of conventional dot printer heads.

Referring first to FIG. 1, there is shown a conventional release type dot printer head which includes a plurality of cores 2 mounted on a yoke 1 in the form of a disk and each having an electromagnetic coils 3 mounted thereon. A permanent magnet 4 in the form of a disk is secured to the yoke 1, and armatures 6 each having a needle 5 secured thereto are individually held on spring plates 7 such that each of the armatures 6 is normally attracted to a corresponding one of the cores 2 due to magnetic fluxes of the permanent magnet 4 whereas it is released therefrom, when the electromagnetic coils 3 are energized to offset the fluxes of the electromagnet 4, to allow a force of the spring plate 7 to move the armature 6 in a printing direction together with the needle 5 thereof.

Figure 2:
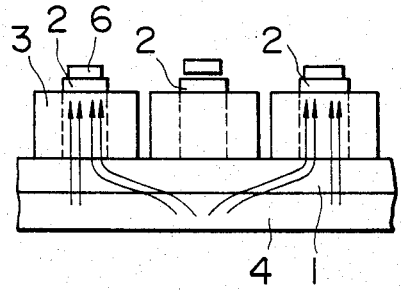
FIGS. 2(*a*) and (*b*) are illustrative views showing flows of magnetic fluxes through the dot printer head of FIG. 1.
Figure 2:
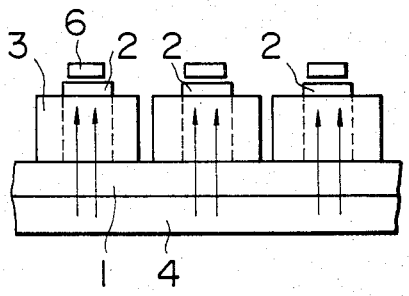
Figure 3:
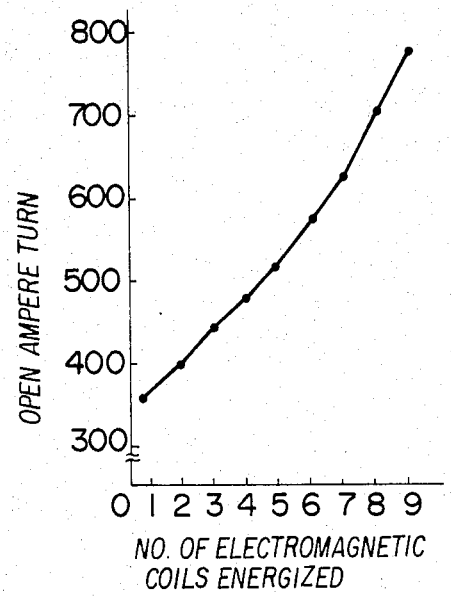
FIG. 3 is a diagram showing a relation between the number of electromagnetic coils energized and the switching ampereturn in the dot printer head.

In this arrangement, however, magnetic interference is normally caused to appear because adjacent cores 2 are magnetically coupled to each other through the yoke 1. In particular, if only a particular (central) one of the electromagnetic coils 3 is energized as illustrated in (a) of FIG. 2, then fluxes of the permanent magnet 4 will be caused to pass the yoke 1 and flow through the cores 2 adjacent thereto so that the fluxes of the permanent magnet 4 will be easily offset or cancelled in the particular core 2. On the contrary, if all of the electromagnetic coils 3 are energized as seen from (b) of FIG. 2, then the magnetic fluxes of the permanent magnet 4 will not flow into adjacent cores 2 and hence they are not so easy to offset or cancel. In this way, actuating conditions will vary depending upon the number of such electromagnetic coils 3 actually energized. In particular, the greater the number of the electromagnetic coils 3 energized as illustrated in of FIG. 3, the greater the switching ampereturn. Thus, a dot printer head of this type is disadvantageous in that, if printing is effected while actuating conditions are held fixed, power consumption will increase correspondingly and besides the printing speed cannot be raised high.

Figure 4:
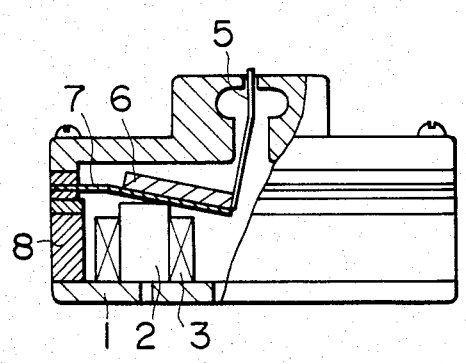
FIG. 4 is a side elevational view, partly in section, showing a second example of conventional dot printer heads.

A different type of dot printer heads are also conventionally used wherein a permanent magnet 8 in the form of a ring is secured to a yoke 1 and extends around an outer periphery of electromagnetic coils 3 as seen from FIG. 4. Also in this arrangement, the individual cores 2 are magnetically coupled to each other through the yoke 1 and hence such defects as described above cannot be eliminated.

Figure 5:
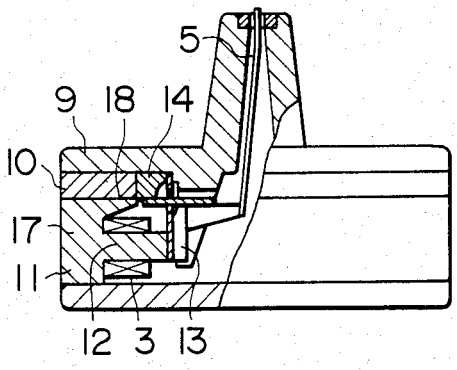
FIG. 5 is a similar side elevational view, partly in section, showing a third example of conventional dot printer heads.
Figure 6:
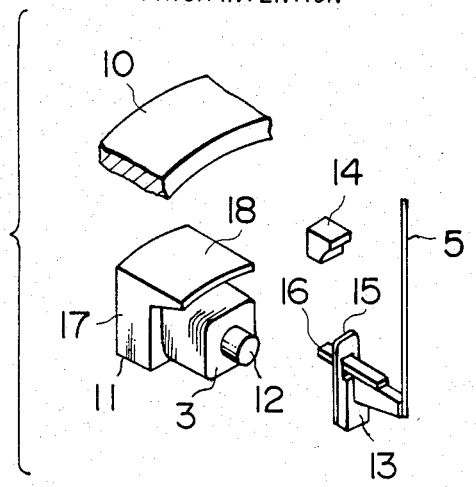
FIG. 6 is a fragmentary perspective view showing a relation between permanent magnets and cores of the dot printer head of FIG. 5.
Figure 7:
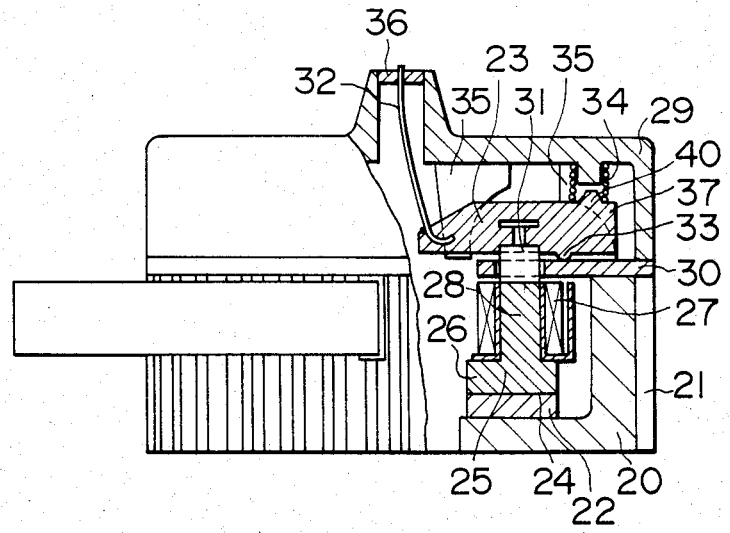
FIG. 7 is a side elevational view, partly in section, showing a first embodiment of a dot printer head according to the present invention.
Figure 8:
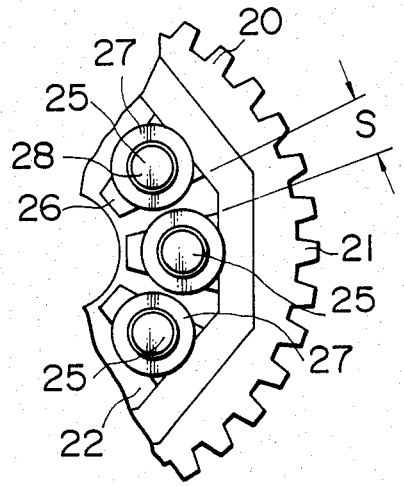
FIG. 8 is a plan view showing part of a yoke of the dot printer head of FIG. 7.
Figure 9:
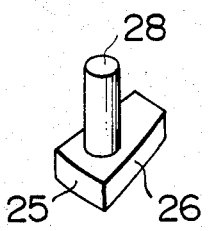
FIG. 9 is a perspective view of a core.
Figure 10:
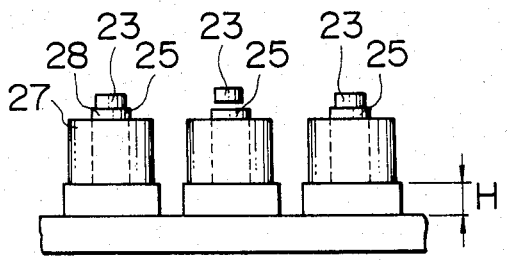
FIG. 10 is a side elevational view showing an arrangement of such cores in a developed form.
Figure 11:
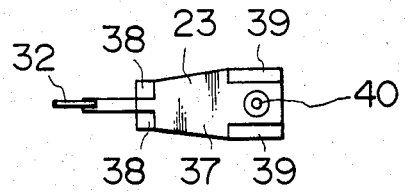
FIG. 11 is a plan view of an armature.
Figure 12:
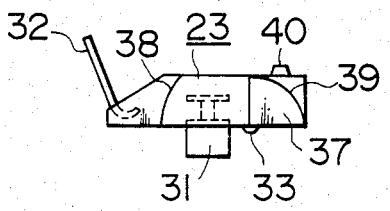
FIG. 12 is a side elevational view of the armature of FIG. 11.
Figure 13:
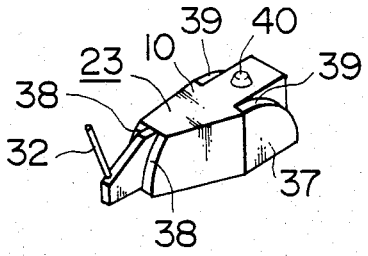
FIG. 13 is a perspective view of the armature of FIG. 11.
Figure 14:
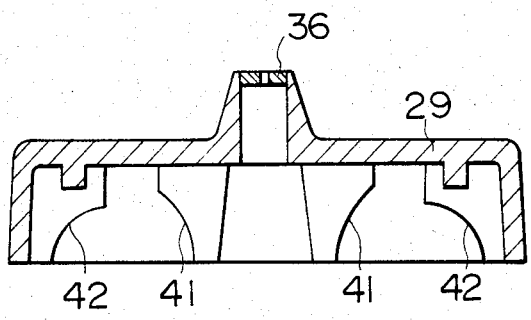
FIG. 14 is a cross sectional view of a guide holder.
Figure 15:
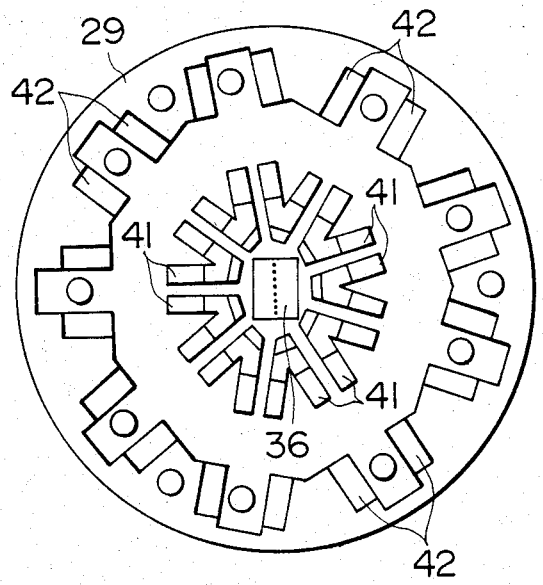
FIG. 15 is a plan view only of the guide holder of FIG. 14.

In view of these circumstances, a further different type of dot printer heads as shown in FIGS. 5 and 6 have been developed. In this arrangement, a doughnut-shaped permanent magnet 10 is secured within a housing 9 and a plurality of cores 11 are adhered to one face of the permanent magnet 10 and disposed in an annular row. A pin 12 extends from each core 11 in parallel relationship to a face of the latter at which it is adhered to the permanent magnet 10. Electromagnetic coils 3 are mounted individually on these pins 12, and armatures 13 each having a needle 5 secured thereto are each urged in a printing direction by means of a mutually crossing spring plates 15 and 16 secured to a block 14.

During operation, fluxes of the permanent magnet 10 are cancelled or offset by those of an electromagnetic coil 3 when energized to allow a force of the spring plates 15, 16 to cause the armature 13 to move in the printing direction. Because the cores 11 of this arrangement are independent of each other, the magnetic reluctance to adjacent cores 11 is greater than that of the arrangement of FIG. 1 or FIG. 4. However, since the area of a face 17 of the core 11 opposing to the adjacent core 11 is larger than that of the arrangement of FIG. 1 or FIG. 4, magnetic fluxes will pass the air and leak to the adjacent cores 11. Further, since a mounting face 18 of the core 11 which extends in parallel to the pin 12 is adhered to the permanent magnet 10, a magnetic path passing the permanent magnet 10, core 11 and armature 13 becomes necessarily longer, causing some magnetic fluxes to flow through the air, which forms a cause of magnetic interference being not prevented assuredly. Moreover, since the mounting face 18 of the core 11 and an end face of the pin 12 (an armature attracting face) are perpendicular to each other, these parts cannot be worked easily, and besides, since the pin 12 is directed not to an open face of the housing 9 but to the center of the housing 9, mounting of the electromagnetic coils 3 is a troublesome operation.

DESCRIPTION OF THE PREFERRED EMBODIMENT

A first embodiment of the present invention will first be described in detail with reference to FIGS. 7 to 15. Reference numeral 20 designates a yoke which has fins 21 formed thereon. The yoke 20 is made of a sintered alloy containing 3% of Silicon in consideration of accuracy of dimensions, magnetic efficiency and economics. A doughnut-shaped permanent magnet 22 is secured to the bottom of the yoke 20, and a plurality of cores 25 are secured to core holding faces 24 of the permanent magnet 22 which are transverse to a line connecting the cores to armatures 23. The cores 25 are normally fixed to the corresponding armatures 23. The cores 25 are made of a sintered alloy containing 2.5 to 3.5% of Silicon in consideration of eddy-current loss and saturation magnetic flux density. Each of these cores 25 has a mounting portion 26 at which it is mounted on the core holding face 24 of a corresponding permanent magnet 22, and also has a post-like projection 28 on which an electromagnetic coil 27 is mounted. The mounting portion 26 is so formed that the area thereof contacting with the core holding face 24 is greater than the area of the cross section of the post-like projection 28 and is preferably trapezoidal with sides forming radii of the array of cores, while the height (H) thereof is made relatively small thereby to substantially assure a relatively large distance (S) between adjacent cores 25. This means that mutual interference between adjacent cores 25 is relatively small even if the distance (S) is small. Further, the mounting portion 26 presents a fan-like configuration in plan such that, when it is viewed from the center of the yoke 20, it has greater width along an outer peripheral side than along an inner peripheral side thereof. Accordingly, although post-like projections 28 of adjacent cores 25 are spaced relatively far apart, the density of magnetic fluxes from the permanent magnet 22 passing through the cores 25 can be held relatively high. A plunger yoke 30 made of a magnetic material is interposed between the yoke 20 and a guide holder 29. The armatures 23 are composed of a plunger 31 of a magnetic material adapted to be fitted in a hole formed in the plunger yoke 30, and a resin piece 37 made of a plastic material having the plunger 31 and a needle 32 implanted thereto. A fulcrum 33 adapted to contact with the plunger yoke 30 is formed to project from a face of the resin piece 37 of the armature 23. The resin piece 37 further has a pair of curved faces 38 formed on opposite sides of one longitudinal portion thereof relative to the fulcrum 33 and another pair of curved faces 39 formed on opposite sides of the opposite longitudinal portion thereof, the curved faces 38 and 39 having their centers at the fulcrum 33 and being different from each other in radius of curvature. Further, the resin piece 37 has a projection 40 formed on the top thereof and adapted to be fitted in one end of a coil spring 34. The armatures 23 of such construction are urged in individual printing directions by the springs 34. The guide holder 29 has a plurality of pairs of guide ribs 35 formed thereon which are adapted to be engaged with the curved surfaces 38, 39 having their centers at the fulcrums 33 of the armatures 23 for guiding pivotal motion of the armatures 23. The guide holder 29 further has a needle guide 36 at an end thereof.

In this arrangement, the plungers 31 of the armatures 23 are normally held attracted to the cores 25 due to the magnetic force of the permanent magnet 22. But if an electromagnetic coil 27 is energized, the magnetic fluxes of the permanent magnet 22 are offset or cancelled accordingly and as a result the associated armature 23 is pivotally moved in its printing direction about its fulcrum 33 by the force of the associated spring 34. As described hereinabove, the cores 25 are disposed in spaced relationship from each other by the distance (S) and are each formed such that the area of the mounting portion 26 thereof which is contacted with the core holding face 24 is relatively large while the length (H) is relatively small. Accordingly, leakage of magnetic fluxes between adjacent cores 25 can be possibly eliminated effectively. Since the permanent magnet 22 is contacted with each of the cores 25 with a face opposing to the armature 23, the length of the magnetic path from the permanent magnet 22 to the armature 23 is small and hence possible leakage of magnetic fluxes which might occur during flowing through an air space can also be prevented. Accordingly, it is possible to prevent an increase of power consumption and to raise the printing speed. Also, since the post-like projection 28 of each core 25 is directed towards an open end of the yoke 20 and perpendicularly to the permanent magnet 22, assembling operations of electromagnetic coils 27 are facilitated. Although the cores 25 are spaced from each other to prevent magnetic interference therebetween, the area 26 of a portion thereof which is contacted with the core holding face 24 is made large and magnetic flux density of the permanent magnet 22 is made high so that the armatures 23 can be attracted rapidly with a strong attractive force. In addition, if a permanent magnet 22 is used which is made of an alloy of cobalt containing a rare earth element, the linearity in the fourth quadrant of the B-H curve (characteristics showiing the relationship between the magnetic flux density and the magnetomotive force) can be improved so that the magnetic force does not decline even where there is a strong reverse magnetic field.

Moreover, the armatures 23 are reduced in weight thereby to allow printing at a high speed. Besides, since each aperture 23 has its fulcrum 33 contacted with a planar part, smooth pivotal motion of the armature 23 is facilitated. In addition, since each armature 23 is held with the curved faces 38, 39 thereof having radii of curvature around the fulcrum 33, the position of the fulcrum 33 is held accurately and hence the stroke of the needle 32 and the impacting force can be made uniform.

It is to be noted that the invention may be embodied otherwise such that the entirety of each armature is made of a magnetic substance and has one end contacted with the yoke so as to form a fulcrum thereat, thereby eliminating such a plunger yoke 30 of the embodiment.

Figure 16:
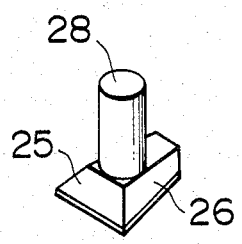
FIG. 16 is a perspective view of a core showing a second embodiment of the invention.
Figure 17:
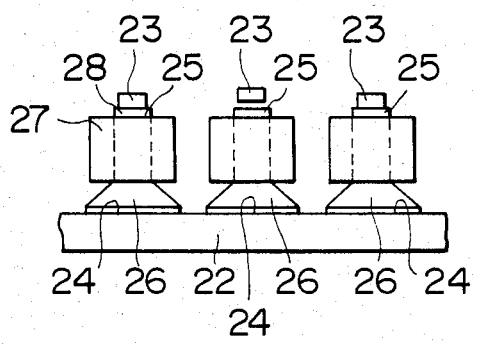
FIG. 17 is a side elevational view showing an arrangement of such cores in a developed form.

Now, a second embodiment of the invention will be decribed with reference to FIGS. 16 and 17. Like elements are designated by like reference numerals to those of the first embodiment, and description thereof will be omitted. A core 25 of this embodiment is characterized in a configuration of a mounting portion 26 thereof at which it is mounted on a core holding face 24. In particular, the mounting portion 26 is designed to have, when viewed from a side, a trapezoidal configuration the width of which is at its maximum at a face thereof at which it is contacted with the core holding face 24 and decreases as remote from the core holding face 24.

Accordingly, magnetic flux density through the cores 25 is not reduced and leakage of magnetic fluxes is low. Particularly, the effective distance between adjacent mounting portions 26 are relatively large since the mounting portions 26 thereof are formed in trapezoidal configurations, and hence leakage of magnetic fluxes between adjacent mounting portions 26 can also be reduced.

What is claimed is:

1. A dot printer head comprising an annular plurality of armatures each mounted for motion to actuate a needle, a spring for urging each of said armatures in a printing direction, a permanent magnet on which cores holding faces are formed in a plane perpendicular to a line connecting said cores and said plurality of armatures, a yoke providing a magnetic path between said permanent magnet and said armatures, and an annular plurality of cores each having a mounting portion contacted with one said core holding face of said permanent magnet, each of said cores further having a post-like projection which extends from said mounting portion and has an electromagnetic coil held thereon, the area of each said mounting portion which is contacted with said core holding face being greater than the area of the cross section of said post-like projection, said cores being secured to said permanent magnet in spaced relationship from each other in an annular row on said core holding faces of said permanent magnet, said area of said mounting portion defining a trapezoid having sides defined by radii of said annular row so that said area of said mounting portion is maximized.

2. A dot printer head according to claim 1, wherein said mounting portion of each of said cores has such a configuration that the area of a face of said mounting portion at which said mounting portion is contacted with said core holding face is maximum, wherein the cross sectional area of said mounting portion gradually decreases with distance from said core holding face.

3. A dot printer head according to claim 1, wherein each of said armatures is formed of a plunger made of a magnetic substance and opposed to one of said cores, and a resin piece for holding said plunger, and wherein a plunger yoke is interposed between said plunger and said yoke.

4. A dot printer head according to claim 3, wherein said plunger yoke is held between and by said yoke and a guide holder which has a needle guide provided thereon.

5. A dot printer head according to claim 3, wherein one end of said needle is implanted in and secured to said resin piece of said armature.

6. A dot printer head according to claim 4, wherein said resin piece of said armature has a fulcrum formed projectingly thereon which is in slidable surface contact with, but not fixed to, said plunger yoke, and also has at least one curved face formed thereon which is centered on said fulcrum and is fitted with said guide holder in order to hold said armature and to maintain a position of said fulcrum during printing.

7. A dot printer head according to claim 3, wherein said plunger yoke has a hole formed therein through which said plunger extends.

* * * * *